US009624886B2

(12) United States Patent
Schmieder et al.

(10) Patent No.: US 9,624,886 B2
(45) Date of Patent: Apr. 18, 2017

(54) HYDRAULIC COUPLING

(71) Applicant: ROBERT BOSCH GMBH, Stuttgart (DE)

(72) Inventors: Dietmar Schmieder, Markgroeningen (DE); Thomas Sebastian, Erdmannhausen (DE); Andreas Jakobi, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 153 days.

(21) Appl. No.: 14/348,998

(22) PCT Filed: Sep. 25, 2012

(86) PCT No.: PCT/EP2012/068832
§ 371 (c)(1),
(2) Date: Apr. 1, 2014

(87) PCT Pub. No.: WO2013/053594
PCT Pub. Date: Apr. 18, 2013

(65) Prior Publication Data

US 2015/0048265 A1 Feb. 19, 2015

(30) Foreign Application Priority Data

Oct. 14, 2011 (DE) ..... 10 2011 084 512

(51) Int. Cl.
*F02M 61/20* (2006.01)
*F02M 51/06* (2006.01)
(Continued)

(52) U.S. Cl.
CPC ..... *F02M 61/205* (2013.01); *F02M 51/0603* (2013.01); *F02M 61/08* (2013.01); *F02M 61/167* (2013.01); *F02M 2200/705* (2013.01)

(58) Field of Classification Search
CPC .. F02M 61/205; F02M 51/0603; F02M 61/08; F02M 61/167; F02M 2200/705
(Continued)

(56) References Cited

U.S. PATENT DOCUMENTS 2,966,351 A * 12/1960 Scholz ..... F02M 19/122 188/298
4,725,002 A * 2/1988 Trachte ..... F02M 51/0603 239/102.2
(Continued)

FOREIGN PATENT DOCUMENTS

DE 102004002134 A1 5/2005
DE 10 2004 002 081 A1 8/2005
(Continued)

*Primary Examiner* — Jessica Cahill
*Assistant Examiner* — Daphne M Barry
(74) *Attorney, Agent, or Firm* — Gerard Messina

(57) ABSTRACT

A hydraulic coupling is specified, particularly for fuel injectors, which has a housing pot having a pot bottom and a lateral pot surface, a piston guided axially displaceably in the housing pot, a fluid-filled coupling gap that is provided between the piston and the pot bottom, diaphragm situated on the outer side of the housing pot facing away from the piston, a compensation chamber that is bordered by the diaphragm and flow-connected to the coupling gap, and a spring element acting upon the diaphragm with an axially directed spring force. In order to achieve a low overall stiffness of the hydraulic coupling at the required specified coupling force, the spring element is developed as a spring bracket fixed to the housing pot, which lies against the diaphragm with axial prestressing in the region of the pot bottom.

11 Claims, 2 Drawing Sheets

(51) Int. Cl.
*F02M 61/08* (2006.01)
*F02M 61/16* (2006.01)

(58) Field of Classification Search
USPC ..... 251/48, 54, 83; 137/61.5, 516.13, 535, 137/538, 543.17, 855; 239/533.2
See application file for complete search history.

(56) References Cited

U.S. PATENT DOCUMENTS

| | | | | |
|---|---|---|---|---|
| 6,739,528 | B2 | 5/2004 | Lorraine et al. | |
| 7,595,579 | B2 * | 9/2009 | Heinz ..... | F02M 51/0603 310/323.01 |

FOREIGN PATENT DOCUMENTS

| | | | |
|---|---|---|---|
| DE | 10 2007 028 490 | A1 | 8/2005 |
| DE | 102004060533 | A1 | 6/2006 |
| DE | 10 2009 026 532 | A1 | 12/2010 |
| DE | 102009045009 | A1 | 3/2011 |
| EP | 1 916 412 | A2 | 4/2008 |
| EP | 2080895 | A1 | 7/2009 |
| EP | 2199591 | A1 | 6/2010 |
| JP | 2000-329028 | A | 11/2000 |
| JP | 2005-516155 | A | 6/2005 |
| RU | 2 272 169 | C2 | 10/2005 |
| RU | 2 191 942 | C2 | 10/2012 |

* cited by examiner

HYDRAULIC COUPLING

CROSS REFERENCE TO RELATED APPLICATION

The present application is the national stage entry of International Patent Application No. PCT/EP2012/068832, filed on Sep. 25, 2012, which claims priority to Application No. DE 10 2011 084 512.7, filed in the Federal Republic of Germany on Oct. 14, 2011.

FIELD OF INVENTION

The present invention is based on a hydraulic coupling, in particular for fuel injectors.

BACKGROUND INFORMATION

One known fuel injector, described in German Application No. DE 10 2004 002 134, has a hydraulic coupling mounted between a valve needle and a piezoelectric actuator, which has a housing pot having a pot bottom and a lateral pot surface, and a piston that is axially displaceable in the housing pot. Between the piston and the pot bottom there is a coupler gap filled with fluid. On the outer side of the pot bottom, facing away from the piston, there is a first diaphragm made of steel, which, together with the pot bottom, encompasses a fluid-filled compensation space. In this context, the first diaphragm covers the pot bottom and is fastened at its edges to the pot bottom by welding. The compensation space is flow-connected to the coupling gap via a throttle element situated in the pot bottom. A second diaphragm made of steel covers an annular gap present between the lateral pot surface and the piston, at the end face of the housing pot facing away from the pot bottom. The annular diaphragm is fastened with its outer diaphragm edge to the lateral pot surface and with its inner diaphragm edge to the piston, by welding. To generate an overpressure in the compensation space, there is a helical compression spring which is supported in the valve housing, having axially directed spring force onto the first diaphragm, a pressure distribution disk being inserted between helical compression spring and the first diaphragm, which lies against the central region of the first diaphragm using a centrical elevation.

SUMMARY

The hydraulic coupling according to the present invention has an advantage that the wall thickness of the diaphragm is able to be kept small and, with that, a slight stiffness is able to be obtained, because of the additional axial spring force when maintaining the coupling force required in the valve installation state of the coupling. By the development of the spring element as a spring bracket, the spring element also has an only slight spring stiffness, so that the stiffness reduction of the coupling obtained by the wall thickness reduction is not offset. All in all, the total stiffness of the coupling is advantageously kept low, so that the coupling clearly fulfills to a tighter tolerance its task of compensation temperature-conditioned, different length changes of two components having different thermal expansion coefficients, between which it is axially mounted. In addition to this, a substantial mounting advantage is achieved by contrast to a spring element developed as a helical compression spring, since the coupling now forms a complete component and is, for instance, able to be inserted into a fuel injector without any special assembly of the spring element. Moreover, the spring force acting upon the diaphragm is able to be set before the insertion of the coupling.

According to one advantageous exemplary embodiment of the present invention, the spring bracket has spring legs reaching over the lateral pot surface and a spring bridge connecting the spring legs to one another, which lies against the diaphragm using its central region. The fixing of the spring bracket is performed using the spring legs, which are connected as a continuous material to the lateral pot surface at its leg ends facing away from the spring bridge. The spring bridge is arched in a concave manner, so that the central contact region is implemented in a simple manner. Because of this constructive design of the spring bracket, the desired axial force acting upon the diaphragm is able to be set very accurately before the continuous-material fixing of the spring legs onto the lateral pot surface, by more or less far axial displacing of the spring legs onto the housing pot.

According to one advantageous exemplary embodiment of the present invention, the spring bracket has two spring legs diametrical to the spring bridge, and the spring legs and the spring bridge are produced in one piece from a spring band by stamping or bending, so that the spring bracket is a component that is cost-effective to manufacture.

According to one advantageous exemplary embodiment of the present invention, the spring band in the region of the spring bridge runs in windings, the windings advantageously being formed so that the spring bridge forms an S-shape with a straight middle leg, and two bent outer legs that continue at each end of the middle leg, and the longitudinal axis of the middle leg and the longitudinal axis of the two spring legs lie in a plane extending at right angles to the spring bridge. Because of this constructive design of the spring bridge, the axial spring force acting by the spring bracket upon the diaphragm is able to be adjusted very accurately using low tolerances.

According to another advantageous exemplary embodiment of the present invention, the spring band is made of high-tensile spring steel, as is also used for the diaphragm, for example.

Exemplary embodiments of the present invention are explained in greater detail in the following description with reference to the accompanying drawings.

DETAILED DESCRIPTION

Figure 1:
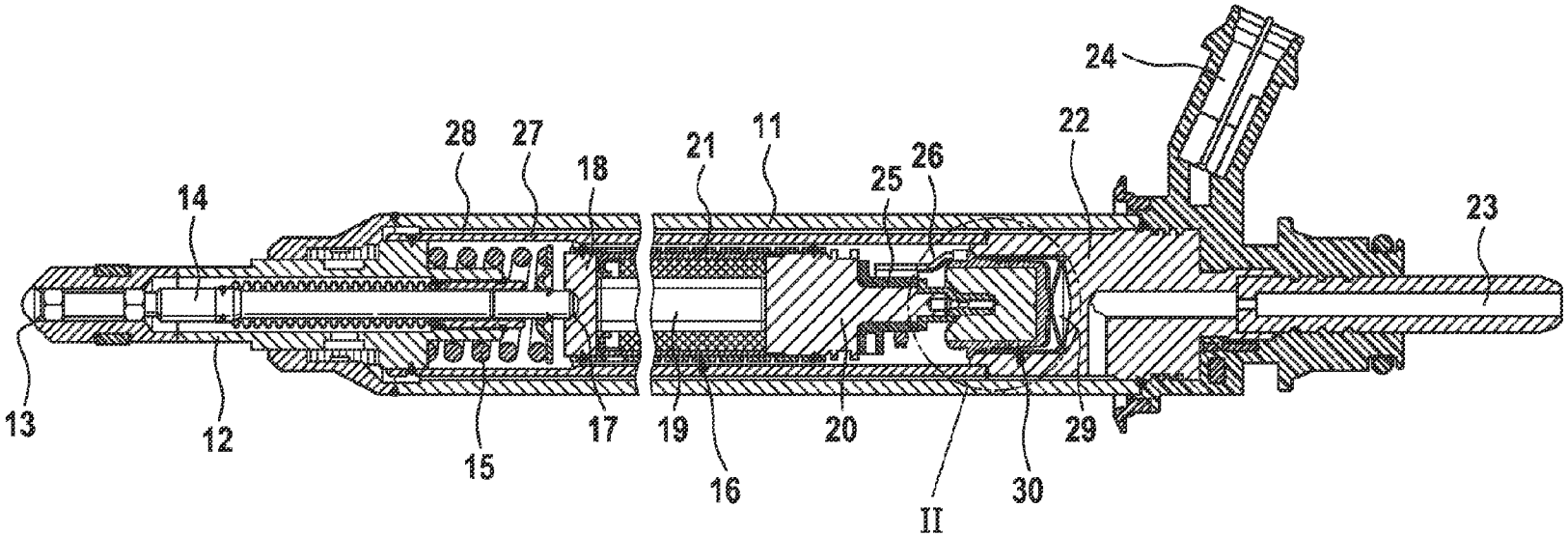
FIG. 1 shows a longitudinal section of a fuel injector having a hydraulic coupling.

The fuel injector, shown in longitudinal section in FIG. 1 as an exemplary embodiment for a general valve for metering a flowing medium, particularly a fluid, has a hollow cylindrical valve housing 11, whose one end face is closed off from a nozzle body or valve body 12 having a spray opening or valve opening 13. Valve opening 13 is controlled by a valve member 14 that opens outwards, which is developed as a valve needle having a closing head, that is, closed or released. The valve member is operated by an actuator 16 against the restoring force of a restoring spring 15 that is supported on valve member 14 and on valve body 12, valve member 14 via its closing head releasing valve opening 13 as a result of an electric voltage applied to actuator 16. Actuator 16 has an electrically actuatable piezo-module 19, also known as a piezostack, which, using a hollow body 21 developed as a spring, is mounted between a closing plate 18 and a closing body 20. Actuator 16, via a Cardanic joint, grips valve member 14, Cardanic joint 17 being developed between the closing head end of the valve needle of valve member 14 and closing plate 18 of actuator 16.

A connecting piece 22 is fixedly set into the end of valve housing 11 facing away from valve body 12. Connecting piece 22 is equipped with a fluid connection 23 and an electrical connecting plug 24. From contact plug 24, using a contact member 25 on the actuator side and a housing side contact member 26 an electrical connection is produced to piezomodule 20 of actuator 16. Electrically conducting parts of the two contact members 25, 26 contact each other and are welded to each other at the contact locations. Alternatively, the parts contacting each other of the two contact members 25, 26 may also be made as one piece. Valve body 12 and connecting piece 22 are fixedly connected to each other via a tube 27, restoring spring 15, actuator 16 and a hydraulic coupling 30 being accommodated in tube 27. Actuator 16 is supported via hydraulic coupling 30 on valve housing 11, or more accurately, on connecting piece 22 that is fixedly connected to valve housing 11.

Figure 2:
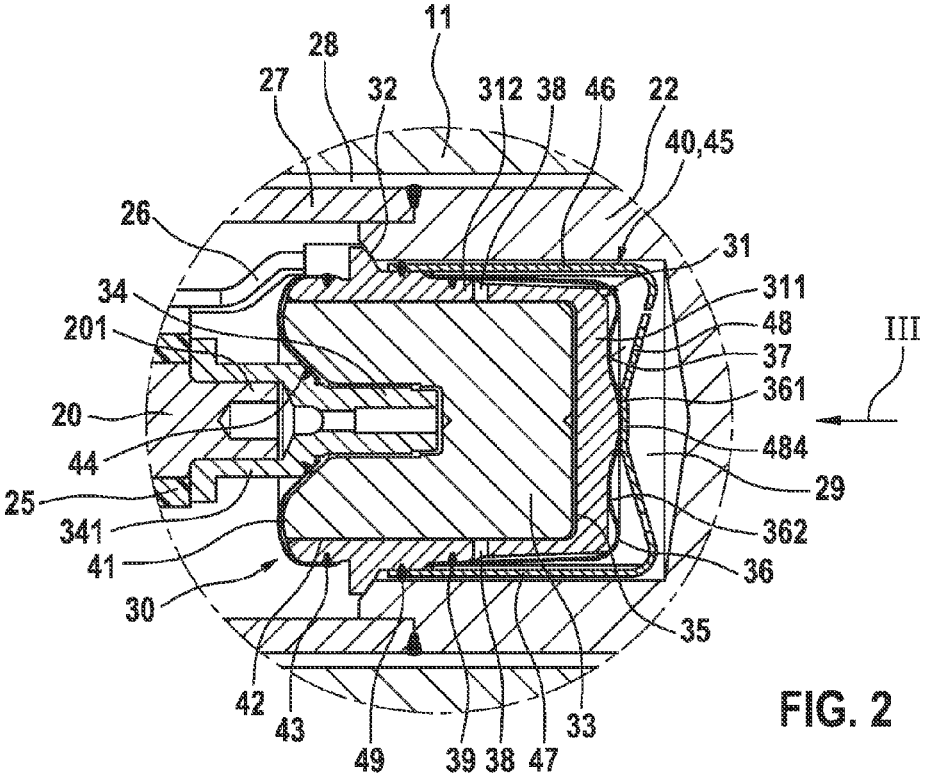
FIG. 2 shows an enlarged view of cutaway view II in FIG. 1.

Hydraulic coupling 30 shown enlarged in longitudinal section in FIG. 2, has a housing pot 31 having a pot bottom 311 and a lateral pot surface 312, as well as a piston 33 guided in an axially displaceable manner. Housing pot 31 is accommodated in a blind end-like recess 29 developed in connecting piece 22 and is Cardanically supported on connecting piece 22. In FIG. 2, an arrow 32 denotes the Cardanic joint. Piston 33 is fixedly connected to actuator 16, for which in piston 33 a central centering bolt 34, having a hollow bolt head 341 sticking out from bolt 34 is fixedly inserted, for example, press-fit into it, and closing body 20 of actuator 16 is provided with an axially sticking out plug 201, which, using its end section reduced in diameter, is pressed into hollow bolt head 341. Between piston 33 and pot bottom 311 of housing pot 31 a coupling gap 35 filled with a fluid, such as oil, is present, and on the outer side of housing pot 31 facing away from piston 33 a thin first diaphragm 36 made of steel is situated, which borders on a compensation space 37 that is flow-connected with coupling gap 35, on the outside of housing pot 31. For this purpose, diaphragm 36 spans pot bottom 311 and is fastened with its diaphragm edge on lateral pot surface 312, for instance, connected as a continuous material to lateral pot surface 312. The continuous material is symbolized in FIG. 2 by a welding seam 39. First diaphragm 36 that is optimized in its design for a specified pressure generation in compensation chamber 37 has a central convex elevation 361 and a concave annular hollow enclosing the former concentrically. The bottom surface of pot bottom 311 facing diaphragm 36 is adapted to the diaphragm shape. A spring element 40 acts with an axially directed spring force on diaphragm 36, so that an additional pressure is built up in fluid-filled compensation chamber 37.

A thin second diaphragm 41 situated at the end face of housing pot 31 that is facing away from pot bottom 311, seals an annular gap 42 that is present between piston 33 and lateral pot surface 312 of housing pot 31 in a fluid-tight manner. Second diaphragm 41, that is also made of steel, is developed in an annular manner for this, and is connected at its outer diaphragm edge to lateral pot surface 312, and at its inner diaphragm edge it is connected to piston 33, in each case as a continuous material. Alternatively, the continuous material at the inner diaphragm edge may also be produced to form centering bolt 34 that is press-fit into piston 33. The continuous material connections are indicated in FIG. 2 by welding seams 43 and 44. The flow connection between coupling gap 35 and compensation chamber 37 is produced by at least one radial bore 38 in lateral pot surface 312. In the exemplary embodiment in FIG. 2, two diametrical radial bores 38 are present, which open out into each other respectively in compensation chamber 37 that is sealed by first diaphragm 36 on the outside of housing pot 31 and in annular gap 42 sealed by second diaphragm 41 between piston 33 and lateral pot surface 312 of housing pot 31. Annular gap 42 acts as a throttle for the fluid flowing between coupling gap 35 and compensation chamber 37.

Figure 3:
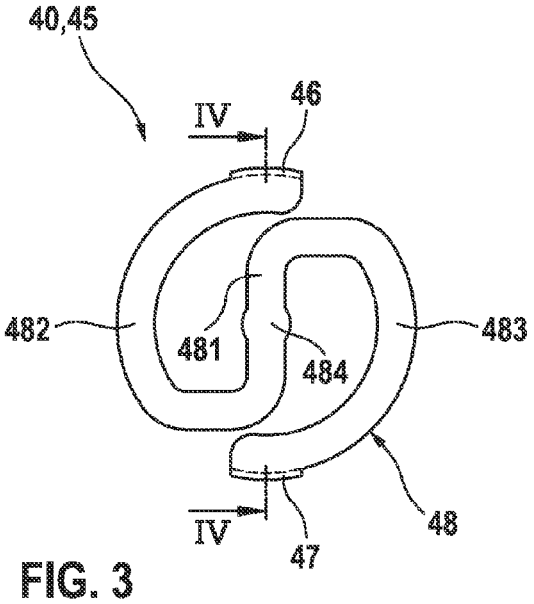
FIG. 3 shows a top view of a spring bracket of the hydraulic coupling in direction III in FIG. 2.
Figure 4:
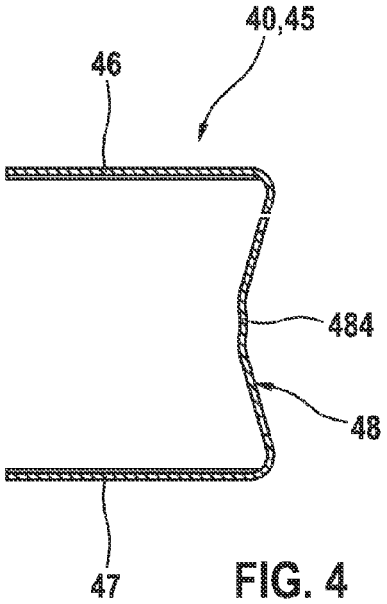
FIG. 4 shows a section along line IV-IV in FIG. 3.

Spring element 40, as shown in FIGS. 2 to 4, is developed as a spring bracket 45, which is fixed on housing pot 31 and lies against diaphragm 36 with axial prestressing. Spring bracket 45 has several, in this case altogether two diametrical spring legs 46, 47 and a spring bridge 48 connecting spring legs 46, 47 to each other. Spring legs 46, 47 reach over the diaphragm region lying against lateral pot surface 312 and are fixed as one material on lateral pot surface 312 using their leg ends facing away from spring bridge 48. The continuous material is again symbolized in FIG. 2 by a welding seam 49. Spring bridge 48 spans the diaphragm region covering pot bottom 311 and presses against first diaphragm 36. For this purpose, spring bridge 48 is arched concavely, that is, it has an inward arching projecting from the bridge edge into the intermediate space between the two spring legs 46, 47, the concave arching of spring bridge 48 having a central region 484, which is adjusted in shape to convex elevation 361 of diaphragm 36. Spring bridge 48 and spring legs 46, 47 are produced in one piece of a spring band as a stamped bent part, high-tensile spring steel being used as the band material. Within the range of spring bridge 48, the spring band runs in windings, as shown in FIG. 3. The windings are formed so that spring bridge 48 has an S-shape having a straight middle leg 481 and two connecting, bent outer legs 482 and 483, which each connect in one piece, each at one end of middle leg 481, and the axis of middle leg 481 and the axes of the two spring legs 46, 47 lie in one plane which extends at right angles to the plane of spring bridge 48. The shape-adjusted central region 484 of the concave arching of spring bridge 48 that lies against convex elevation 361 of first diaphragm 36 is developed on middle leg 481, and spring legs 46 and 47 are bent off at right angles from outer legs 482 and 483. Spring legs 46, 47 are axially pushed so far onto housing pot 31 that spring bridge 48 presses onto first diaphragm 36 using the desired prestressing.

What is claimed is:

1. A hydraulic coupling for fuel injectors, comprising:

a housing pot having a pot bottom and a lateral pot surface, a piston guided axially displaceably in the housing pot, a fluid-filled coupling gap that is present between the piston and the pot bottom, a diaphragm situated on an outer side of the housing pot facing away from the piston, which diaphragm borders a compensation chamber that is flow-connected to the coupling gap, and a spring element acting, using an axially directed spring force, upon the diaphragm, wherein the spring element is adapted as a spring bracket fixed to the housing pot, the spring bracket presses against the diaphragm in a region of the pot bottom, and the spring bracket is axially prestressed; and wherein the spring bracket has spring legs overlapping the lateral pot surface, and a spring bridge that connects the spring legs to each other, which lies against the diaphragm using a central region.

2. The hydraulic coupling according to claim 1, wherein the spring bridge is arched concavely.

3. The hydraulic coupling according to claim 1, wherein a fixing of the spring bracket is undertaken using the spring legs on the lateral pot surface.

4. The hydraulic coupling according to claim 3, wherein leg ends of the spring legs facing away from the spring bridge are connected in a continuous material to the lateral pot surface of the housing pot.

5. The hydraulic coupling according to claim 1, wherein the spring bracket has two diametrically situated spring legs, and the spring legs and the spring bridge are made in one piece of a spring band as a stamped bent part.

6. The hydraulic coupling according to claim 5, wherein the spring band runs in windings in a region of the spring bridge.

7. The hydraulic coupling according to claim 6, wherein the windings are formed such that the spring bridge has an S-shape having a straight middle leg and two bent outer legs adjoining the middle leg at each end, a longitudinal axis of the middle leg of the spring bridge and longitudinal axes of the two spring legs lying in a plane that extends at right angles to the spring bridge.

8. The hydraulic coupling according to claim 5, wherein the spring band is made of high-tensile spring steel.

9. The hydraulic coupling according to claim 1, wherein the diaphragm spans the pot bottom and is connected using its diaphragm edge to the lateral pot surface in a continuous material.

10. The hydraulic coupling according to claim 1, wherein the diaphragm has a central, convex elevation and a concave annular hollow enclosing the elevation; and wherein the spring bridge is concavely arched and lies on the diaphragm using the central region of the spring bridge that is shape-adjusted to the convex elevation of the diaphragm.

11. A hydraulic coupling for fuel injectors, comprising:

a housing pot having a pot bottom and a lateral pot surface, a piston guided axially displaceably in the housing pot, a fluid-filled coupling gap that is present between the piston and the pot bottom, a diaphragm situated on an outer side of the housing pot facing away from the piston, which diaphragm borders a compensation chamber that is flow-connected to the coupling gap, and a spring element acting, using an axially directed spring force, upon the diaphragm, wherein the spring element is adapted as a spring bracket fixed to the housing pot, the spring bracket presses against the diaphragm in a region of the pot bottom, and the spring bracket is axially prestressed, and wherein at least one radial bore is situated for flow connection of the coupling gap and the compensation chamber in the lateral pot surface of the housing pot which, on the one hand, is open towards the compensation chamber and, on the other hand, towards an annular gap that is present between the piston and the lateral pot surface of the housing pot; and the annular gap is covered on an end face of the housing pot facing away from the pot bottom by an annular-shaped diaphragm, which is respectively fixed in a fluid-tight manner to the lateral pot surface with its outer diaphragm edge and to the piston with its inner diaphragm edge.

* * * * *